US005754982A

United States Patent [19]

Gainer

[11] Patent Number: 5,754,982

[45] Date of Patent: May 26, 1998

[54] VEST HOLD-DOWN SYSTEM FOR BALLISTIC RESISTANT VEST

[76] Inventor: C. Morgan Gainer, 2 Fiddlers Cove Pl., The Woodlands, Tex. 77381

[21] Appl. No.: 749,724

[22] Filed: Nov. 15, 1996

[51] Int. Cl.[6] ..... F41H 1/02

[52] U.S. Cl. ..... 2/2.5; 2/102; 2/117

[58] Field of Search ..... 2/78.4, 112, 2, 2/2.5, 908, 92, 102, 920, 919, 115, 117, 229, 403, 408, 406, 44, 120

[56] References Cited

U.S. PATENT DOCUMENTS

| | | | |
|---|---|---|---|
| 1,246,274 | 11/1917 | Jelalian | 2/2.5 |
| 1,998,085 | 4/1935 | Jones | 2/304 |
| 3,696,439 | 10/1972 | Durham | 2/2.5 |
| 4,597,109 | 7/1986 | Hironaga | 2/304 |
| 4,697,285 | 10/1987 | Sylvester | 2/2.5 |
| 4,884,295 | 12/1989 | Cox | 2/2.5 |
| 5,060,314 | 10/1991 | Lewis | 2/2.5 |
| 5,072,453 | 12/1991 | Widder | 2/2.5 |
| 5,398,340 | 3/1995 | Kibbee | 2/2.5 |
| 5,495,621 | 3/1996 | Kibbee | 2/2.5 |

*Primary Examiner*—C. D. Crowder
*Assistant Examiner*—Larry D. Worrell, Jr.
*Attorney, Agent, or Firm*—Kenneth A. Roddy

[57] ABSTRACT

A vest hold-down system for ballistic resistant vests includes a form fitting elastic lower body undergarment having a waist portion, a crotch portion, and leg portions, with strips of hook-and-loop fastener material on the front and rear portions; and an upper body vest made of flexible fabric having a front member with lateral side portions which extend around the sides of a wearer and are releasably connected with a back member, elastic shoulder straps connecting the front and back members which extend over the wearer's shoulders, and pockets in the front and rear members and lateral side portions which receive ballistic resistant pads or panels. A pair of laterally adjacent generally rectangular front flaps of flexible fabric extends downwardly from the front member and terminates a distance below the wearer's waist, and at least one generally rectangular rear flap of flexible material extends downwardly from the back member and terminates a distance below the wearer's waist. The front and rear flaps are releasably engaged on the front and rear portions of the undergarment by mating elements of the hook-and-loop fasteners. The elastic undergarment and shoulder straps prevent excessive pulling forces on the shoulders and crotch area of the wearer and prevent excessive movement of the vest relative to the body which may otherwise impede or interfere with the wearer's movements or expose the wearer to injury when engaged in strenuous physical activity.

13 Claims, 6 Drawing Sheets

VEST HOLD-DOWN SYSTEM FOR BALLISTIC RESISTANT VEST

BACKGROUND OF THE INVENTION

1. Field of the Invention

This invention relates generally to bulletproof garments, and more particularly to a vest hold-down system including an undergarment and ballistic resistant vest combination which are releasably attached to maintain the vest in a comfortable position and prevent the vest from moving during physical activity.

2. Brief Description of the Prior Art

Law enforcement, security, and military personnel faced with possible life threatening situations often wear "bulletproof" or "ballistic resistant" vests when performing their duties. The conventional "bulletproof" or "ballistic resistant" vest is usually worn beneath the uniform shirt or jacket and is formed of a flexible lightweight fabric material such as Nylon having a front member and back member that are provided with pockets into which relatively stiff generally rectangular ballistic resistant pads or panels are removably installed. Common ballistic resistant pads or panels are formed of bulletproof or ballistic resistant material such as KEVLAR (tm) manufactured by DuPont Company of Wilmington Del., or SPECTRA SHIELD (tm) manufactured by Allied Signal Inc., of Morristown, N.J. These relatively stiff pads or panels cause the vest to become semi-rigid and move relative to the body of the wearer.

Thus, the conventional bulletproof or ballistic resistant vests with the stiff pads or panels installed will ride up toward the chin of the wearer when the wearer assumes a sitting position such as driving a patrol car, and will move relative to the body when the wearer is engaged in strenuous physical activity such as running, climbing, bending over, or struggling to apprehend a suspect, which in some cases may impede or interfere with the wearer's movements and may expose the wearer to serious injury.

There are several patents which disclose various bulletproof, ballistic resistant, or protective vests.

Stone et al, U.S. Pat. Nos. 5,073,985 and 5,331,683 disclose ballistic resistant vests having a front and rear flap of the flexible lightweight fabric material which extend downwardly a distance beyond the waist portion of the front and rear panels, respectively. These flaps are tucked into the trousers of the wearer in the manner of "shirt tails" and are intended to hold the vest in place when the trousers belt is fastened around the waist. However, the flaps are uncomfortable as they become wadded up and tend to slide up upwardly out of the trousers as the person wearing the vest with the rigid plates installed assumes a sitting position or is engaged in strenuous physical activity. The front flap is a large single rectangular piece of material which requires male wearers to drop their trousers or to move the large flap to one side when using a urinal.

Braunhut, U.S. Pat. No. 4,497,069 discloses a modular ballistic resistant garment having a strap harness onto which various body protecting panels or pads are attached using hook and loop and elastic fasteners. There is no provision for preventing the garment from riding up on the wearer.

Lewis, U.S. Pat. No. 5,060,314 discloses a ballistic resistant jacket consisting of a back panel, left and right front panels in combination with side portions, and a permanent collar which are adjustably attached together using hook and loop and elastic fasteners. Floatation accessories are also provided which attach to the jacket. An accessory leg strap is provided for use when the floatation accessories are installed to assure the wearer is maintained in a floating survival posture. The leg strap is a Y-shaped configuration having a base strap releasably connected to the back panel which passes beneath the crotch and between the buttocks and two branch straps which are releasably connected to the front panels. The leg strap is connected to the vest panels by bayonet buckle type fasteners.

Miller, U.S. Pat. No. 4,593,788 discloses a rescue vest having a back portion, left and right front portions, and shoulder portions with groin straps attached to the lower ends of the front portions which enable a person to be lifted by means of the vest. The groin straps extend from the front portions, loop around the wearer's legs, and are connected again to the front portions with a buckle assembly.

Miles, U.S. Pat. No. 4,302,847 discloses a zippered vest having a resilient foam insert for protection while participating in various sports activities. The vest is held in position by right and left crotch straps which are anchored to the back portion of the vest by a metal ring and at the front of the vest just forward of the hip bone by a left and right ring buckle.

The leg straps and groin straps of the prior art are unsatisfactory for use for extended periods of time and would be extremely uncomfortable when sitting, and also when the wearer is engaged in strenuous physical activity such as running, climbing, bending over, or struggling to apprehend a suspect, and in some cases may impede or interfere with the wearer's movements.

The present invention is distinguished over the prior art in general, and these patents in particular by a vest hold-down system for ballistic resistant vests which includes a form fitting elastic lower body undergarment having a waist portion, a crotch portion, and leg portions, with strips of hook-and-loop fastener material on the front and rear portions; and an upper body vest made of flexible fabric having a front member with lateral side portions which extend around the sides of a wearer and are releasably connected with a back member, elastic shoulder straps connecting the front and back members which extend over the wearer's shoulders, and pockets in the front and rear members and lateral side portions which receive ballistic resistant pads or panels. A pair of laterally adjacent generally rectangular front flaps of flexible fabric extends downwardly from the front member and terminate a distance below the wearer's waist, and at least one generally rectangular rear flap of flexible material extends downwardly from the back member and terminates a distance below the wearer's waist. The front and rear flaps are releasably engaged on the front and rear portions of the undergarment by mating elements of the hook-and-loop fasteners. The elastic undergarment and shoulder straps prevent excessive pulling forces on the shoulders and crotch area of the wearer and prevent excessive movement of the vest relative to the body which may otherwise impede or interfere with the wearer's movements or expose the wearer to injury when engaged in strenuous physical activity.

SUMMARY OF THE INVENTION

It is therefore an object of this invention to provide a vest hold-down system for ballistic resistant vests which will not impede or interfere with the wearer's movements when engaged in strenuous physical activity such as running, climbing, bending over, or struggling to apprehend a suspect, which might otherwise expose the wearer to serious injury.

It is another an object of this invention to provide a vest hold-down system for ballistic resistant vests which prevents excessive movement of the vest relative to the body of the wearer when being worn.

Another object of this invention is to provide a vest hold-down system for ballistic resistant vests which will prevent the vest from riding up toward the chin of the wearer when the wearer assumes a sitting position such as driving a vehicle or sitting at a desk or table.

Another object of this invention is to provide a vest hold-down system for ballistic resistant vests the utilizes stretchable elastic shoulder straps and an elastic undergarment which provides a comfortable fit and eliminates excessive pulling forces on the shoulders and crotch or groin area of the wearer.

A still further object of this invention is to provide a vest hold-down system for ballistic resistant vests which is simple in construction, economical to manufacture, and is safe and reliable in use.

Other objects of the invention will become apparent from time to time throughout the specification and claims as hereinafter related.

The above noted objects and other objects of the invention are accomplished by a vest hold-down system for ballistic resistant vests which includes a form fitting elastic lower body undergarment having a waist portion, a crotch portion, and leg portions, with strips of hook-and-loop fastener material on the front and rear portions; and an upper body vest made of flexible fabric having a front member with lateral side portions which extend around the sides of a wearer and are releasably connected with a back member, elastic shoulder straps connecting the front and back members which extend over the wearer's shoulders, and pockets in the front and rear members and lateral side portions which receive ballistic resistant pads or panels. A pair of laterally adjacent generally rectangular front flaps of flexible fabric extends downwardly from the front member and terminates a distance below the wearer's waist, and at least one generally rectangular rear flap of flexible material extends downwardly from the back member and terminates a distance below the wearer's waist. The front and rear flaps are releasably engaged on the front and rear portions of the undergarment by mating elements of the hook-and-loop fasteners. The elastic undergarment and shoulder straps prevent excessive pulling forces on the shoulders and crotch area of the wearer and prevent excessive movement of the vest relative to the body which may otherwise impede or interfere with the wearer's movements or expose the wearer to injury when engaged in strenuous physical activity.

DESCRIPTION OF THE PREFERRED EMBODIMENT

Figure 1:
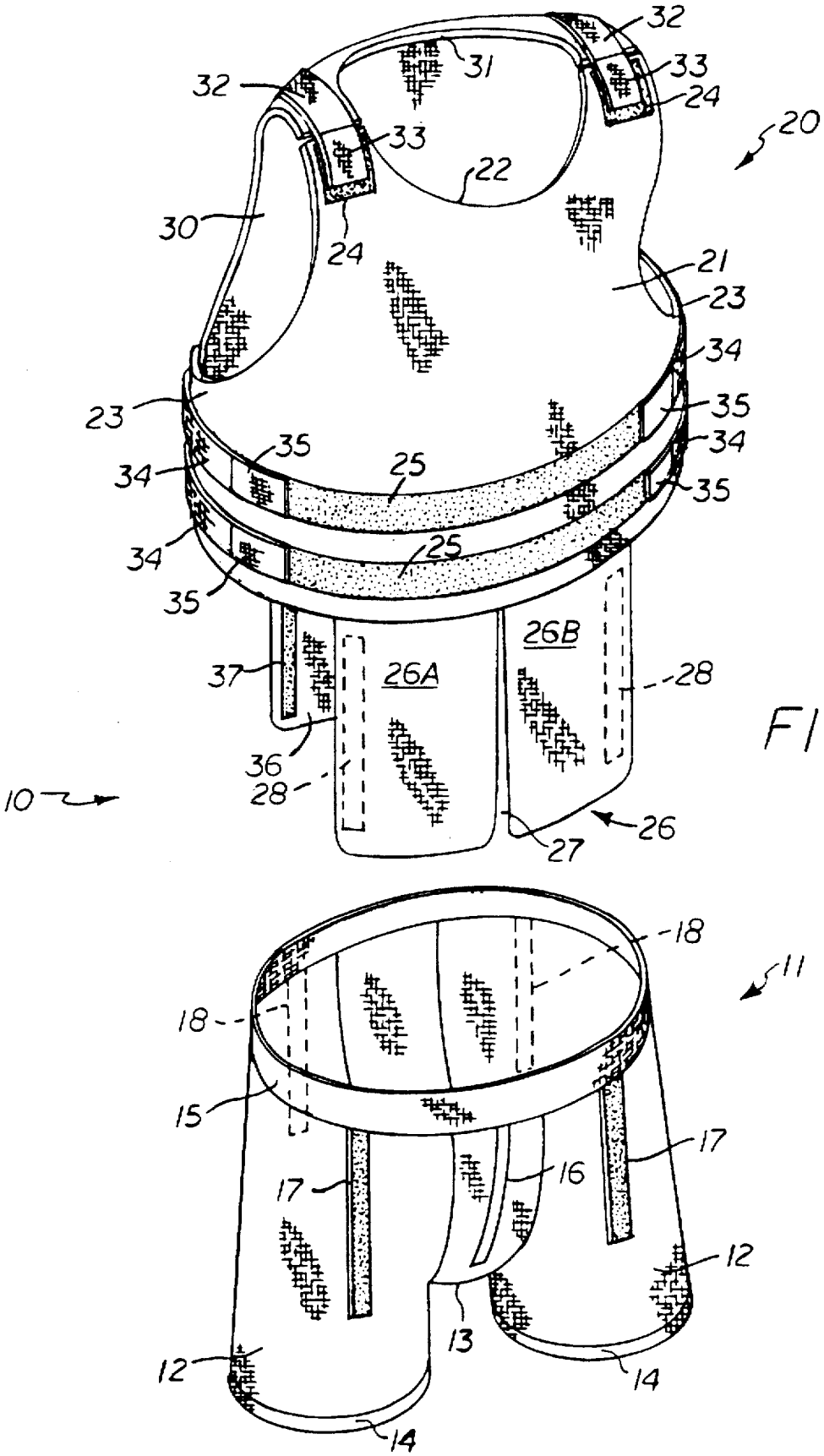
FIG. 1 is a perspective view of the undergarment and vest of the vest hold-down system in accordance with the present invention shown in an unassembled condition.

Referring to the drawings by numerals of reference, there is shown in FIG. 1, a preferred vest hold-down system 10 for ballistic resistant vests, in an unfastened condition. The vest hold-down system 10 has a form fitting lower body undergarment 11 and an upper body vest 20.

The undergarment 11 is made of panels of soft flexible elastomeric fabric material and includes first and second leg portions 12 joined together by a crotch panel defining a crotch portion 13 which extends from the front to the rear of the undergarment. In a preferred embodiment, the leg portions 12 extend several inches below the crotch portion 13 and are hemmed at their lower ends 14, in the fashion of a tight fitting athletic short, however, it should be understood that the undergarment may have shorter leg portions, or leg openings, in the fashion of briefs.

An elastic waist band 15 is sewn to the top ends of the leg and crotch panels 12 and 13. In an embodiment for male wearers, a closable fly 16 is formed in the front of the crotch portion 13. In an embodiment for female wearers, the crotch portion would not require a fly.

The undergarment is preferably formed of a resilient stretch fabric blend, such as 95% cotton and 5% spandex, to closely conform to the lower body of the wearer. It should be understood that other blends and resilient stretch fabrics may also be used.

A first pair of strips 17 of one element of hook-and-loop fastener material are secured to the front of the undergarment 11 to extend vertically downward from the waist band 15 along the front of the leg portions 12. A second pair of strips 18 of one element of hook-and-loop fastener material are secured to the rear of the undergarment 11 to extend vertically downward from the waist band 15 along the rear of the leg portions 12. The strips 17 and 18 are approximately ¾" wide and about 6"–8" long and are secured by conventional means such as sewing.

The upper body vest 20 includes a front member 21 and a back member 30. The front and back members 21 and 30 are each made of an outer sheet and an inner upper and inner lower sheet of flexible fabric material such as Nylon or a fabric blend such as polyester and cotton which are superposed and sewn together along their peripheries (described hereinafter) to form an envelope configuration.

Figure 2:
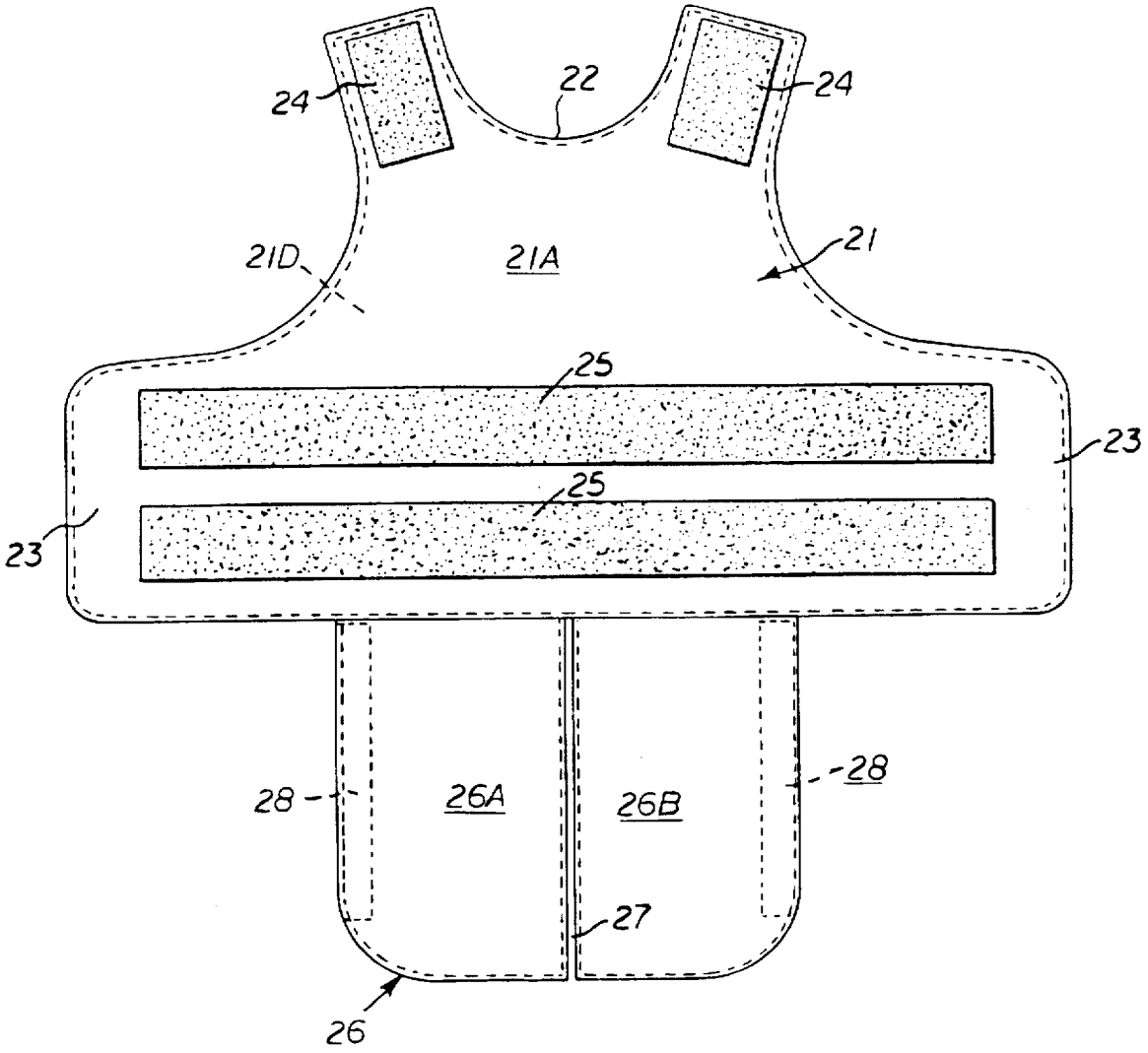
FIG. 2 is an elevation view of the outward facing side of the front member of the upper body vest.
Figure 3:
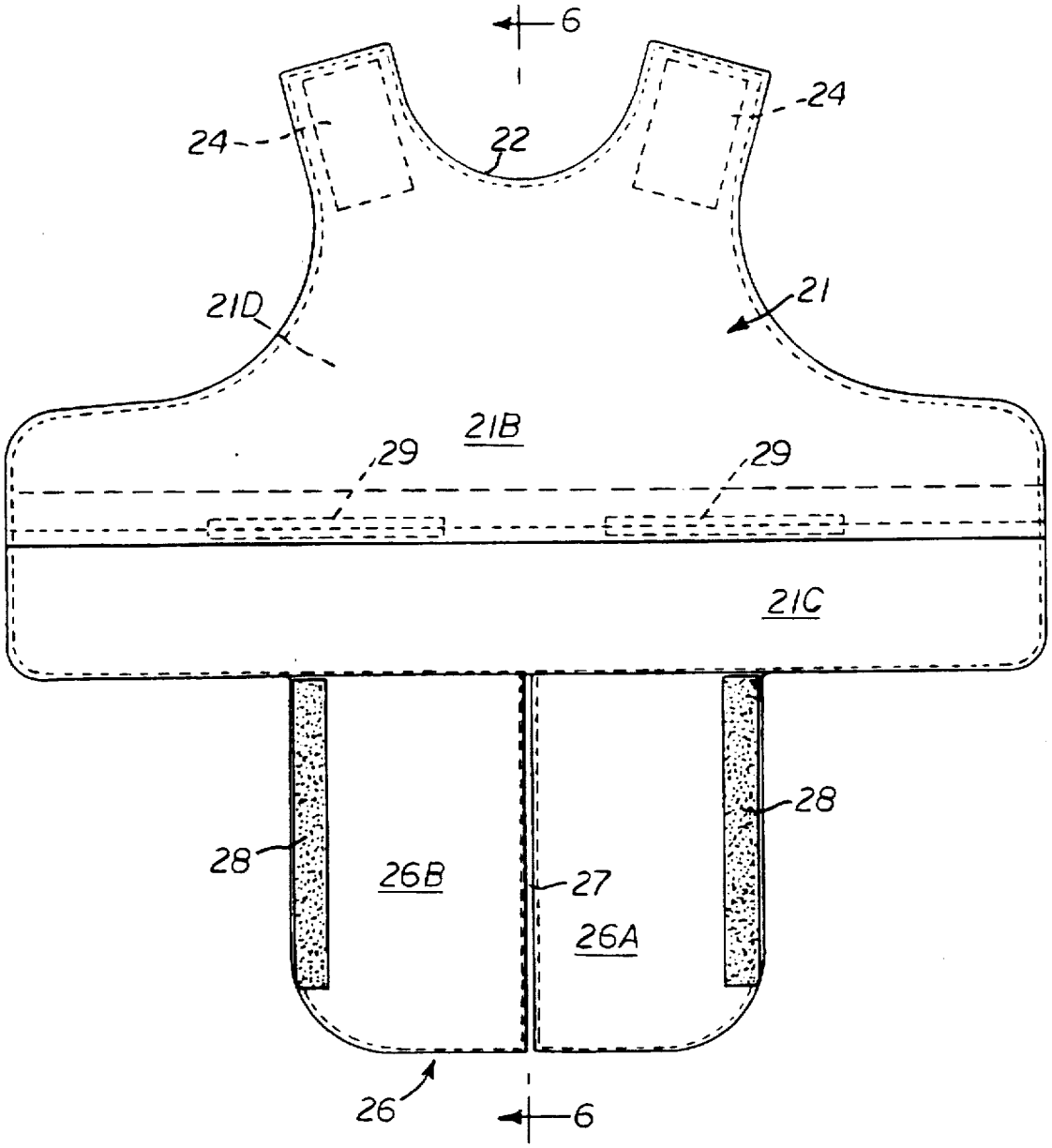
FIG. 3 is an elevation view of the inward facing side of the front member of the upper body vest.
Figure 4:
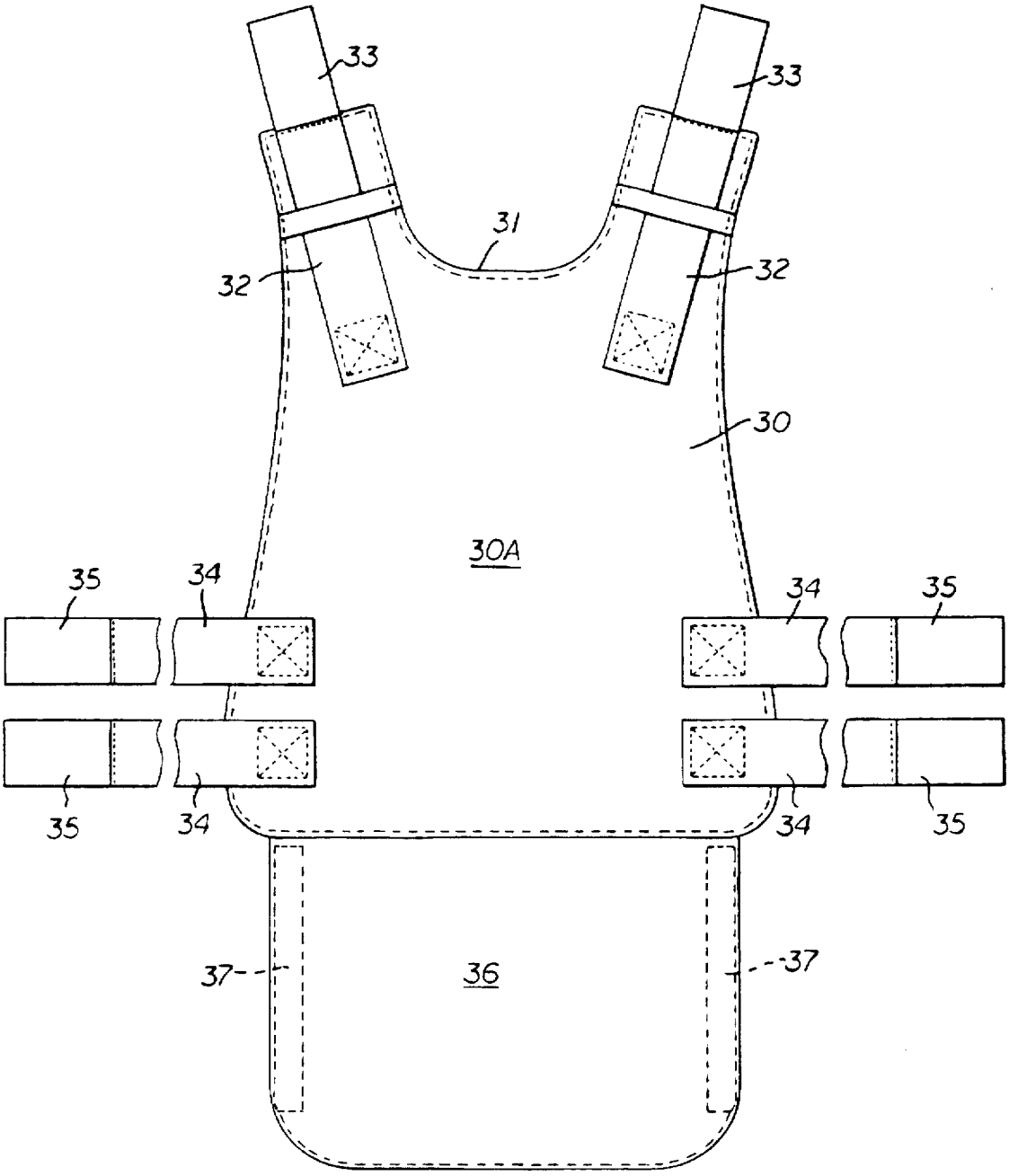
FIG. 4 is an elevation view of the outward facing side of the back member of the upper body vest.
Figure 5:
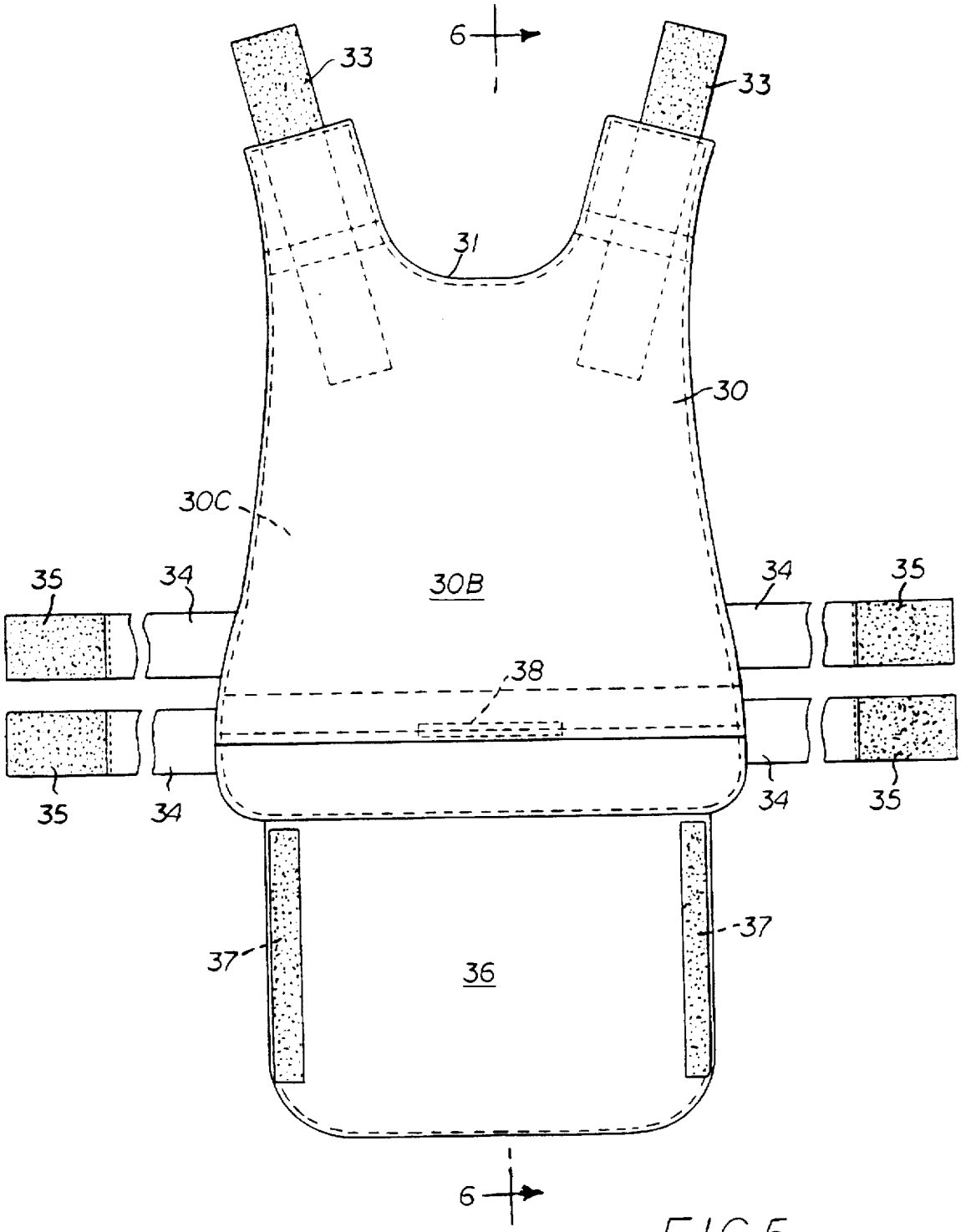
FIG. 5 is an elevation view of the inward facing side of the back member of the upper body vest.
Figure 6:
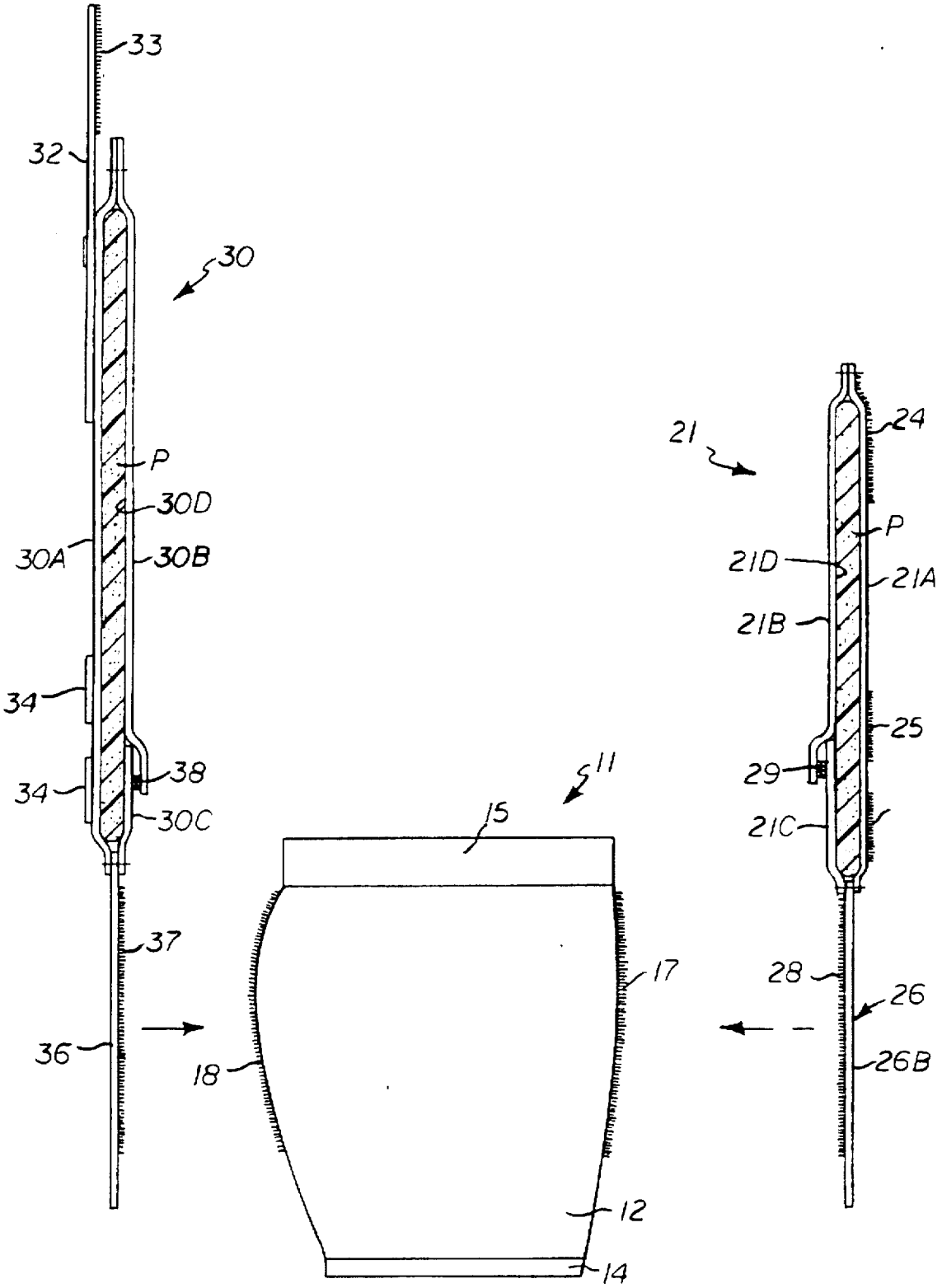
FIG. 6 is longitudinal cross section through the front and back members of the upper body vest positioned adjacent to the undergarment.

Referring additionally to FIGS. 2, 3, and 6, the front member 21 of the vest 20 has a U-shaped cutout at its top end defining a neck portion 22 and its lateral sides curve downwardly and outwardly from the top end to define outwardly extending laterally opposed side portions 23. A pair of rectangular strips 24 of one element of hook-and-loop fastener material are secured to the front or outer facing surface of the front member 21, one on each side of the neck portion 22. A pair of strips 25 of one element of hook-and-loop fastener material are secured transversely across the front of the front member 21 and side portions 23 in parallel vertically spaced relation. A generally rectangular front flap 26 is secured at its top end to the bottom end of the front member 21 and extends a distance downwardly therefrom. A vertical slit 27 divides the front flap 26 into a pair of laterally adjacent front flaps 26A and 26B. A pair of rectangular strips 28 of one element of hook-and-loop fastener material are secured to the undersides of the front flaps 26A and 26B, one along each outer longitudinal side of each front flap.

The hook-and-loop strips 28 on the front flaps releasably engage the hook-and-loop strips 17 on the front of the leg portions 12 of the undergarment (FIGS. 1 and 6). In the engaged or fastened condition, the slit 27 overlies the fly 16 in the crotch portion 13 of the undergarment 11 and the front flaps 26A and 26B overlie the front of the leg portions 12.

Thus, front member 21 of the vest 20 is anchored to the front of the undergarment 11 by the front flaps 26A and 26B. The front flaps 26A and 26B also move with the leg portions 12 of the undergarment 11 and relative to one another.

The front member 21 is made of an outer sheet 21A and an inner upper sheet 21B and inner lower sheet 21C of the flexible fabric material which are superposed and sewn together along their peripheries to form an envelope configuration. The outer sheet 21A has the shape as described above with the U-shaped neck portion 22 at its top end and lateral sides curved downwardly and outwardly from the top end to define the outwardly extending laterally opposed side portions 23. The inner lower sheet 21C of the flexible fabric has the same general shape of the lower portion and side portions 23 of the outer sheet 21A and is superposed on the inner facing side of the lower and side portions of the outer sheet 21A, and is sewn to the inner facing side of the front sheet along its bottom and side edges, and its top edge is open to form the lower portion of a large pocket 21D. The inner upper sheet 21B has the same general shape as the upper and side portions of the outer sheet 21A and is superposed on the inner facing side of the upper and side portions of the outer sheet, and is sewn to the inner facing side of the outer sheet along its top and side edges. The bottom edge of the inner upper sheet 21B terminates a distance below, and overlaps the top edge of the inner lower sheet 21C.

Several rectangular strips of mating hook-and-look fastener material are secured along the top edge of the inner lower sheet 21C and the bottom edge of the inner upper sheet 21B, such that the bottom edge of the upper sheet can be releasably fastened to the top edge of the lower sheet in the overlapped relation. Thus, the inner upper and lower sheets 21B and 21C form a large pocket 21D on the inner facing side of the front member 21 with an closable opening extending transversely across the inner lower portion of the front member. The overlapped opening facilitates insertion of a ballistic pad or panel P into the large pocket 21D (described hereinafter).

Referring now to FIGS. 1, 4, 5, and 6, the back member 30 of the upper body vest 20 is made of flexible fabric material and has a U-shaped cutout at its top end defining a neck portion 31 and its lateral sides extend downwardly from the top end. A pair of rectangular elastic shoulder straps 32 are secured at one end to the upper end of the back member 30 and each has a rectangular strip 33 of one element of hook-and-loop fastener material secured to its free end. A pair of rectangular elastic waist straps 34 are secured at one end to the back member 30 adjacent its lateral sides to extend laterally therefrom in parallel vertically spaced relation and each has a rectangular strip 35 of one element of hook-and-loop fastener material secured to its free end. A generally rectangular rear flap 36 is secured at its top end to the bottom end of the back member 30 and extends a distance downwardly therefrom. A pair of rectangular strips 37 of one element of hook-and-loop fastener material are secured to the underside of the rear flap 36, one along each outer longitudinal side.

The hook-and-loop strips 37 on the rear flap 36 releasably engage the hook-and-loop strips 18 on the rear of the leg portions 12 of the undergarment 11. In the engaged or fastened condition, the rear flap 36 overlies the rear and leg portions 12 of the undergarment 11. Thus, the back member 30 of the vest 20 is anchored to the rear of the undergarment 11 by the rear flap 36.

Although the rear flap 36 is illustrated as a single flap, it should be understood that the rear flap may also be slit and divided into a pair of laterally adjacent rear flaps in the same manner as the front flaps described above. In this modification the pair of adjacent rear flaps would move with the leg portions 12 of the undergarment 11 and relative to one another.

The back member 30 is made of an outer sheet 30A and an inner upper 30B and inner lower sheet 30C of the flexible fabric material which are superposed and sewn together along their peripheries to form an envelope configuration. The outer sheet 30A has the shape as described above with the U-shaped neck portion and lateral sides which extend downwardly from the top end. The inner lower sheet 30C of the flexible fabric has the same general shape of the lower portion of the outer sheet 30A and is superposed on the inner facing side of the lower portion of the outer sheet, and is sewn to the inner facing side of the outer sheet along its bottom and side edges and is open at its top end to form the lower portion of a large pocket 30D. The inner upper sheet 30B has the same general shape as the upper and side portions of the outer sheet 30A and is superposed on the inner facing side of the upper and side portions of the outer sheet, and is sewn to the inner facing side of the outer sheet along its top and side edges. The bottom edge of the inner upper sheet 30B terminates a distance below, and overlaps the top edge of the inner lower sheet 30C.

One or more rectangular strips 38 of mating hook-and-look fastener material are secured along the top edge of the inner lower sheet 30C and the bottom edge of the inner upper sheet 30B, such that the bottom edge of the upper sheet can be releasably fastened to the top edge of the lower sheet in the overlapped relation. Thus, the inner upper and lower sheets 30B and 30C form a large pocket 30D on the inner facing side of the back member 30 with a closable opening extending transversely across the inner lower portion of the back member. The overlapped opening facilitates insertion of a ballistic pad or panel P into the large pocket 30C (described below).

As best seen in FIG. 6, front and back ballistic pads or panels P, are removably installed in the large pockets 21D and 30D in the front and back members 21 and 30, respectively. The ballistic pads or panels P are formed of bulletproof or ballistic resistant material such as KEVLAR (tm) manufactured by DuPont Company of Wilmington Delaware, or SPECTRA SHIELD (tm) manufactured by Allied Signal Inc., of Morristown, N.J. These ballistic resistant pads or panels are commercially available and therefore the details of their construction are not shown or described in detail.

In a preferred embodiment, the front ballistic pad or panel P has the same general shape as the front member 21 of the vest 20 including the side portions 23, and the back ballistic pad or panel P has the same general shape as the back member 30. The conventional ballistic pads or panels P are approximately ¾" thick and are relatively stiff and heavy. Each of the pads or panels is installed by inserting its top end through the overlapped opening of the large pockets 21D and 30D in the respective front or back member 21 and 30 and pushing it upwardly into the upper portion of the respective member. The lower end of the pad or panel is then inserted into the lower portion of the large pocket in the respective member. After the ballistic pads or panels have been installed, the large pockets 21D and 30D are closed by pressing the overlapped edges of the pockets together to engage the mating hook-and-loop fasteners. It should be understood that several ballistic pads or panels having different shapes may be installed in the large pockets rather than a single pad or panel in each pocket.

The front and back members 21 and 30 of the vest 20 are connected together by engaging the hook-and-loop fasteners 33 at the free ends of the elastic shoulder straps 32 with the mating hook-and-loop fasteners 24 at the top end of the front member 21. The vest 20 is then supported on the shoulders of the wearer with the front member 21 and rear member 30 draped over the chest and back of the wearer. The shoulder straps 32 may be adjusted as necessary so that the lower end of the members 21 and 30 are positioned at the wearer's waist area and the flaps 26A, 26B and 36 extending below the waist. One laterally extending side portion 23 of the front member 21 is wrapped around the side of the wearer and held in position while the hook-and-loop fasteners 35 at the free ends of the elastic waist straps 34 extending from the back member 30 are engaged with the mating hook-and-loop fasteners 25 at the lower portion of the front member 21. This procedure is repeated for the opposite side and the waist straps 34 may be adjusted as necessary so that the side portions 23 are connected with the back member 30 and the vest 20 is comfortably engaged around the waist of the wearer.

After the vest is properly fitted to the torso of the wearer, the front flaps 26A and 26B and rear flap 36 are connected to the front and rear, respectively, of the leg portions 12 of the undergarment 11 by engaging the hook-and-loop fasteners 28 and 37 at the lateral sides of the flaps with the mating hook-and-loop fasteners 17 and 18 along the front and rear of the respective leg portions. The flaps 26A, 26B, and 36, and the shoulder straps 32 may be readjusted as necessary so that wearer can assume a comfortable sitting position.

Thus, the vest 20 with the heavy relatively stiff ballistic pads or panels installed is supported on the shoulders of the wearer, comfortably encircles the waist, and is anchored or held in place by the undergarment 11.

Although the relatively stiff pads or panels cause the vest to become semi-rigid, the vest is anchored to the undergarment and excessive movement of the vest relative to the body of the wearer is prevented. Thus, law enforcement, security, and military personnel equipped with the present vest hold-down system can carry out their duties without the problems associated with conventional ballistic resistant vests.

Because the vest is anchored to the undergarment, the vest will not ride up toward the chin of the wearer when the wearer assumes a sitting position such as driving a patrol car, and will not move relative to the body when the wearer is engaged in strenuous physical activity such as running, climbing, bending over, or struggling to apprehend a suspect, which in some cases may impede or interfere with the wearer's movements and may expose the wearer to serious injury. The combination of the elastic shoulder straps at the top end of the vest and the elastic undergarment connected at the lower end also allow the wearer to assume various positions without excessive pulling forces on the shoulders and crotch or groin area.

While this invention has been described fully and completely with special emphasis upon a preferred embodiment, it should be understood that within the scope of the appended claims the invention may be practiced otherwise than as specifically described herein.

I claim:

1. A vest hold-down system for ballistic resistant vests comprising in combination:

a form fitting lower body undergarment made of soft elastic material having a waist portion, a crotch portion, front, rear, side, and leg portions, and a first and second pair of laterally spaced strips of one element of hook-and-loop fastener material on said front and rear portions, respectively;

an upper body vest made of flexible material having a front member, a back member, lateral side portions interconnected with said front and back members to extend around the sides of a wearer, elastic shoulder straps interconnected with said front and back members to extend over the wearer's shoulders, and pockets in said front and rear members and said side portions for receiving panels of ballistic resistant material;

a pair of laterally adjacent generally rectangular front flaps of flexible material extending downwardly from said vest front member terminating a distance below the wearer's waist, at least one generally rectangular rear flap of flexible material extending downwardly from said vest back member and terminating a distance below the wearer's waist, and a third and fourth pair of laterally spaced strips of a mating element of said hook-and-loop fastener material on said front and rear flaps, respectively, to releasably engage said first and second pair of laterally spaced strips of hook-and-loop fastener material on said front and rear portions of said undergarment.

2. The vest hold-down system according to claim 1 further comprising panels of ballistic resistant material removably installed in said pockets in said front and rear members and said side portions.

3. The vest hold-down system according to claim 1 wherein each one of said first pair of said laterally spaced strips of one element of hook-and-loop fastener material is secured to a front surface of a respective one of said undergarment leg portions, and each one of said second pair of laterally spaced strips of one element of hook-and-loop fastener material is secured to a rear surface of a respective one said undergarment leg portions; and each one of said third pair of laterally spaced strips of said hook-and-loop fastener material is secured to a respective one of said pair of laterally adjacent front flaps such that each one of said front flaps moves with said respective said leg portions and relative to one another.

4. The vest hold-down system according to claim 3 further comprising a closable fly in a front portion of said crotch portion; and said pair of laterally adjacent generally rectangular front flaps extend downwardly from said vest front member to define an opening therebetween overlying said closable fly.

5. The vest hold-down system according to claim 1 wherein each one of said second pair of laterally spaced strips of said hook-and-loop fastener material is secured to a rear surface of a respective one of said undergarment leg portions.

6. The vest hold-down system according to claim 5 wherein said at least one generally rectangular rear flap comprises a pair of laterally adjacent generally rectangular rear flaps of flexible material extending downwardly from said vest back member terminating a distance below the wearer's waist; and each one of said fourth pair of laterally spaced strips of said hook-and-loop fastener material is secured to a respective one of said pair of laterally adjacent rear flaps such that each one of said rear flaps moves with said respective said leg portions and relative to one another.

7. The vest hold-down system according to claim 1 wherein said vest lateral side portions are integral with said front member, at least one fifth pair of strips of one element of hook-and-loop fastener material is secured one to an outer surface of each said side portion; and at least one pair of rectangular elastic waist straps each secured at one end to a respective opposed lateral side of said back member to extend outwardly therefrom and each said waist strap having a strip of a mating element of hook-and-loop fastener material secured to its free end;

said vest front member lateral side portions extending around the sides of said wearer and releasably connected with said back member by engaging said strips of hook-and-loop fastener material at the free ends of said waist straps with said at least one fifth pair of strips of hook-and-loop fastener material on said lateral side portions.

8. In a vest hold-down system for ballistic resistant vests, an undergarment comprising:

a form fitting lower body undergarment made of soft elastic material having a waist portion, a crotch portion, front, rear, and side portions, and leg portions, and a first and second pair of laterally spaced strips of one element of hook-and-loop fastener material on said front and rear portions, respectively;

each one of said first pair of said laterally spaced strips of one element of hook-and-loop fastener material is secured to a front surface of a respective one of said undergarment leg portions, and each one of said second pair of laterally spaced strips of one element of hook-and-loop fastener material is secured to a rear surface of a respective one of said undergarment leg portions, and said first pair of laterally spaced strips of hook-and-loop fastener material positioned on said front surface to releasably engage strips of mating elements of hook-and-loop fastener material secured to laterally adjacent front flaps extending downward from a waist portion of an upper body vest, and said second pair of laterally spaced strips of hook-and-loop fastener material positioned on said rear surface to releasably engage strips of mating elements of hook-and-loop fastener material secured to a rear flap extending downwardly from the waist portion of the upper body vest.

9. The undergarment according to claim 8 further comprising a closable fly in a front portion of said crotch portion.

10. In a vest hold-down system for ballistic resistant vests, an upper body ballistic resistant vest comprising:

an upper body vest made of flexible material having a front member, a back member, lateral side portions interconnected with said front and back members to extend around the sides of a wearer, elastic shoulder straps interconnected with said front and back members to extend over the wearer's shoulders, and pockets in said front and rear members and said lateral side portions for receiving panels of ballistic resistant material;

a pair of laterally adjacent generally rectangular front flaps of flexible material extending downwardly from said vest front member terminating a distance below the wearer's waist, at least one generally rectangular rear flap of flexible material extending downwardly from said vest back member and terminating a distance below the wearer's waist, and a first and second pair of laterally spaced strips of one element of hook-and-loop fastener material on said front and rear flaps, respectively;

said first and second pair of laterally spaced strips of hook-and-loop fastener material positioned on said front and rear flaps to releasably engage strips of mating elements of hook-and-loop fastener material secured to front and rear portions of an undergarment worn by said wearer.

11. The vest according to claim 10 further comprising panels of ballistic resistant material removably installed in said pockets in said front and rear members and said lateral side portions.

12. The vest according to claim 10 wherein said at least one generally rectangular rear flap comprises a pair of laterally adjacent generally rectangular rear flaps of flexible material extending downwardly from said vest back member terminating a distance below the wearer's waist.

13. The vest according to claim 10 wherein said vest lateral side portions are integral with said front member, at least one third pair of strips of one element of hook-and-loop fastener material is secured one to an outer surface of each said side portion; and at least one pair of rectangular elastic waist straps each secured at one end to a respective opposed lateral side of said back member to extend outwardly therefrom and each said waist strap having a strip of a mating element of hook-and-loop fastener material secured to its free end;

said vest front member lateral side portions extending around the sides of said wearer and releasably connected with said back member by engaging said strips of hook-and-loop fastener material at the free ends of said waist straps with said at least one third pair of strips of hook-and-loop fastener material on said lateral side portions.

* * * * *